United States Patent [19]

Riley et al.

[11] Patent Number: 4,573,684

[45] Date of Patent: Mar. 4, 1986

[54] PUZZLES

[76] Inventors: Alfred T. Riley, 1 Sunfield Dr., Royton, Oldham; Barry Lord, 93 Helmshore Rd., Holcombe Village, Bury, Lancashire, both of United Kingdom

[21] Appl. No.: 673,224

[22] Filed: Nov. 20, 1984

Related U.S. Application Data

[63] Continuation of Ser. No. 495,210, May 16, 1983, abandoned.

[30] Foreign Application Priority Data

May 18, 1982 [GB] United Kingdom ..... 8214494

[51] Int. Cl.[4] ..... A63F 9/10

[52] U.S. Cl. ..... 273/157 R

[58] Field of Search ..... 273/157 R

[56] References Cited

U.S. PATENT DOCUMENTS 601,811 4/1898 Landes ..... 273/157 R 4,052,074 10/1977 Fogle et al. ..... 273/157 R

*Primary Examiner*—Anton O. Oechsle

*Attorney, Agent, or Firm*—W. Thad Adams, III

[57] ABSTRACT

A jigsaw comprises a plurality of pieces which can be assembled to form a picture, design, shape or some other representation, some pieces being reversible so as to at least partially alter the character of the representation. Opposite faces of some pieces may bear a different picture, color, design, symbol or other marking so that reversing them alters the visual effect of the representation, or some pieces may be non-symmetric such that reversing them actually alters the shape of the representation.

7 Claims, 5 Drawing Figures

PUZZLES

This application is a continuation, of application Serial No. 495,210, filed May 16, 1983, abandoned.

BACKGROUND OF THE INVENTION

The invention relates to puzzles and particularly to jigsaw puzzles.

DESCRIPTION OF THE PRIOR ART

Jigsaw puzzles conventionally comprise a sheet of timber, card or the like, bearing a picture on one face, cut into a plurality of pieces which can be assembled to reform the picture. However once a jigsaw has been done once, it tends to lose its appeal.

OBJECT OF THE INVENTION

The invention seeks to overcome this problem by providing a jigsaw which is more versatile and interesting than a conventional jigsaw.

SUMMARY OF THE INVENTION

According to the invention a jigsaw comprises a plurality of pieces which can be assembled to form a picture, design, shape or some other representation, at least one of the pieces being reversible with respect to other pieces so as to at least partially alter the character of the representation.

Opposite faces of the piece may bear a different picture, colour, design, symbol or other marking, so that reversing it alters the visual effect of the representation.

Alternatively, or in addition, the piece may be of a non-symmetric shape such that reversing it actually alters the shape of the representation.

The puzzle may, for example, comprise a plurality of pieces which can be assembled to form an animal or part thereof (e.g. the face of an animal).

The puzzle may be such that reversal of one or more pieces gives the animal a different facial expression.

The puzzle may. when assembled, have an outline which represents the outline shape of the animal or part thereof.

The puzzle may be such that reversal of one or more pieces alters the outline shape of the animal or part thereof.

Further objects, features and advantages of the invention will become apparent from the following description of a specific embodiment of the invention.

DESCRIPTION OF ONE EMBODIMENT OF THE INVENTION

Figure 1:
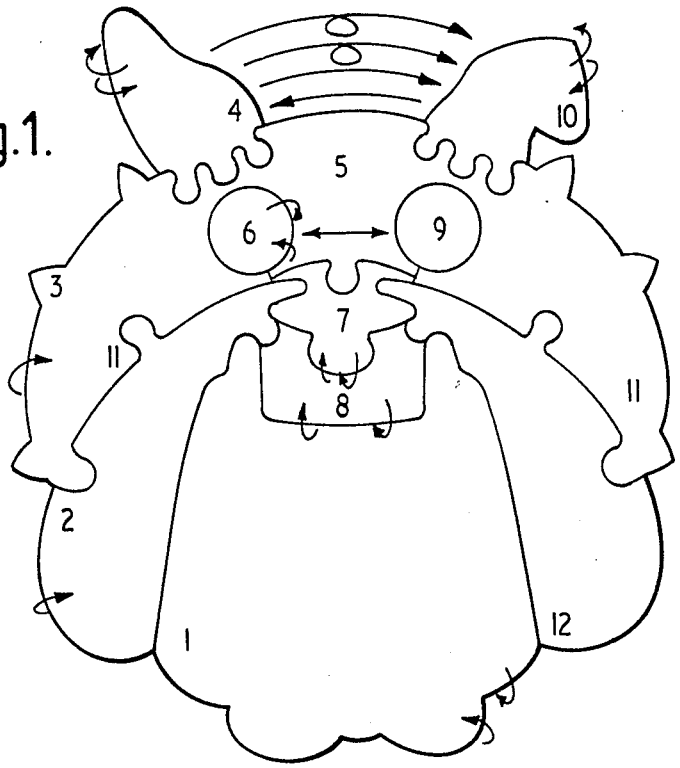
FIG. 1 is a plan view showing the shapes of the parts of an assembled jigsaw puzzle according to an embodiment of the invention.
Figure 4:
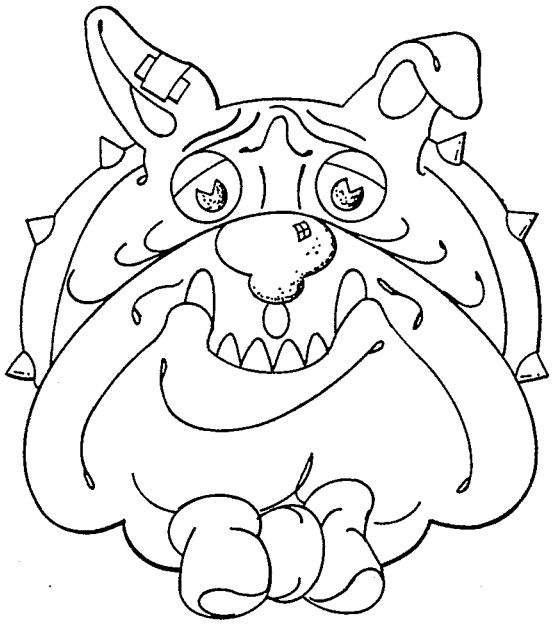
FIG. 4 is a plan view illustrating one representation that can be formed by assembling the puzzle.

FIG. 1 illustrates a jigsaw puzzle having twelve pieces represented by the reference numerals 1 to 12 which, when assembled, provide the outline shape of the head of a bulldog. FIG. 1 is intended to show the shapes of the pieces, and does not therefore illustrate the artwork which is applied to each piece but the effect that the finished puzzle provides, both in shape and as to picture, is represented in FIG. 4.

The pieces of the puzzle are such that at least some of the pieces may be reversed with respect to other pieces. For example pieces 4, 10, 6, 9, 7, 8, and 1 may be reversed, individually or in any combination, and then be replaced in their original positions.

In addition, the positions of pieces 4 and 10 may be swapped, as can the positions of pieces 6 and 9, the positions of pieces 3 and 11, and the positions of pieces 2 and 12.

Figure 5:
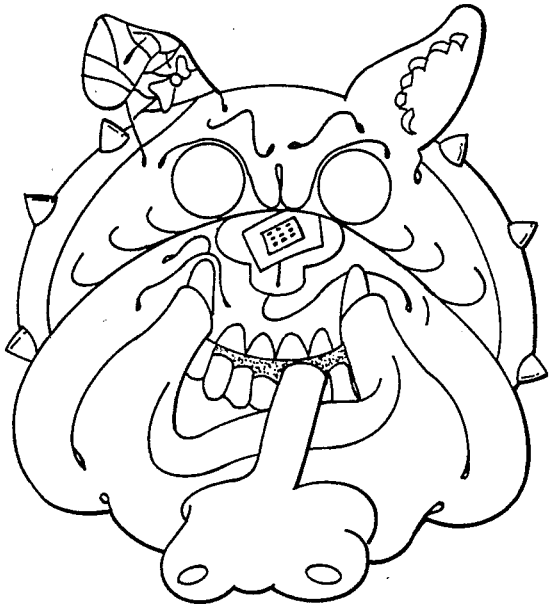
FIG. 5 is a view similar to FIG. 4 but illustrating an altered representation which can be formed by the pieces of the same puzzle.

Some of the pieces, for example pieces 6, 9, 7, 8 and 1 are symmetric, and reversal of them does not alter the outline shape of the bulldog's face. Since however the opposite sides of the pieces bear different artwork, the visual appearance of the face can be altered. Thus it is possible to change the expression of the bulldog and the changes that can be effected will be apparent from a comparison of FIGS. 4 and 5. For example the eyes, nose and mouth may be altered, and in the FIG. 5 representation the bulldog can be represented as chewing a bone, whereas in FIG. 4 the bulldog is represented as having a closed mouth and a bow-tie.

Reversal of pieces can be used not only to change the visual appearance, but also to change the outline shape. For example pieces 4 and 10 are not symmetric, so that reversal or swapping of these pieces actually alters the outline shape, as can be seen from a further comparison of FIGS. 4 and 5.

Figure 2:
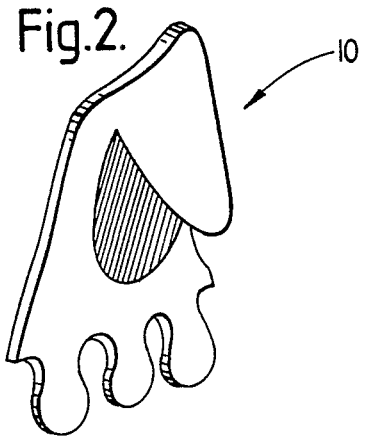
FIGS. 2 and 3 are perspective views showing opposite faces of one of the pieces of the puzzle.
Figure 3:
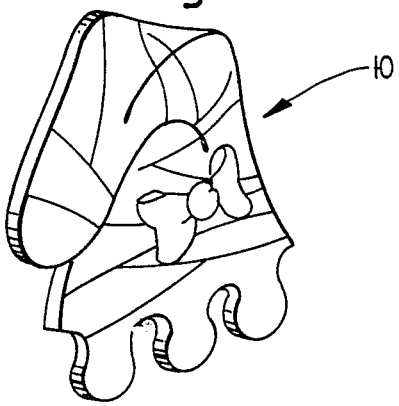

Piece 10 is illustrated in more detail in FIGS. 2 and 3. One side of the piece, as shown in FIG. 2, represents a conventional drooping ear. However as can be seen from FIG. 3, reversal of this piece causes the ear to droop in a different direction, and the ear is represented as being bandaged.

The invention is not restricted to the details of the foregoing embodiment. For instance the principle of the invention can be applied to any representation whatsoever, including for example humans, other living species, inanimate objects, and is not limited to the representation of animals.

We claim:

1. A jigsaw toy comprising a plurality of central pieces and edge-defining pieces having first and second faces, at least some of the pieces having cooperating narrow mouthed sockets and enlarged heads for enabling the pieces to be interlocked to form a coherent shape; at least one of said edge-defining pieces being asymmetrical and removable from a first position in which said first face is displayed and is reversible to display said second face, and then replaceable in said first position, said at least one edige-defining piece also being removable from said first position to a second position, said replacement of said at least one edge-defining piece in said first position and movement of said at least one edge-defining piece to said second position altering the visual effect of said coherent shape without substantially altering the outline of said coherent shape, at least some of said pieces having indicia on at least their first faces such that intelligible composite designs are formed when said first piece displays both its first and second faces in said first position and when said first piece is disposed in said second position.

2. A jigsaw toy according to claim 1, in which at least some of said pieces are reversible and said first and second faces of said reversible pieces bear a different design whereby reversing one or more of said pieces alters the visual effect of the jigsaw toy.

3. A jigsaw toy according to claim 1, wherein said pieces are reversible and said first and second faces of said pieces bear different designs so that reversing some or all of the pieces alters the design.

4. A jigsaw toy according to claim 1, wherein said puzzle toy comprises a plurality of pieces which can be assembled to form a design representing an animal or a part of an animal.

5. A jigsaw toy according to claim 3 in which the pieces can be assembled to form the face of an animal.

6. A jigsaw toy according to claim 5, in which the pieces of the puzzle are reversible and bear a design in such form as to give the animal a different facial expression when said pieces are reversed from the first face to the second face.

7. A jigsaw toy according to claim 4, wherein the shape of the jigsaw toy represents the outline of an animal or a part of an animal.

* * * * *